United States Patent [19]

Ogino et al.

[11] Patent Number: 4,762,165

[45] Date of Patent: Aug. 9, 1988

[54] ARC MELTING AND CASTING METHOD AND APPARATUS THEREOF

[75] Inventors: Sekiya Ogino, Kyoto; Shigehiko Inoue, Osaka; Touru Tomai, Kyoto; Masami Tamura, Osaka, all of Japan

[73] Assignee: Kabushiki Kaisha Morita Seisakusho, Kyoto, Japan

[21] Appl. No.: 944,335

[22] Filed: Dec. 18, 1986

[30] Foreign Application Priority Data

Dec. 23, 1985 [JP] Japan ..... 60-289726

[51] Int. Cl.[4] ..... B22D 13/06; B22D 18/00; B22D 18/06; B22D 27/02

[52] U.S. Cl. ..... 164/457; 164/61; 164/63; 164/68.1; 164/114; 164/147.1; 164/154; 164/258; 164/259; 164/287; 164/289; 164/495; 164/499; 164/514

[58] Field of Search ..... 164/495, 514, 457, 499, 164/147.1, 61, 63, 68.1, 114, 154, 258, 259, 287, 289

[56] References Cited

U.S. PATENT DOCUMENTS

| | | | |
|---|---|---|---|
| 1,199,281 | 9/1916 | Lanier | 164/514 |
| 2,652,440 | 9/1953 | Simmons | 164/514 X |
| 2,749,585 | 6/1956 | Prosen | 164/514 |
| 3,293,706 | 12/1966 | Dunlop | 164/514 |
| 3,476,170 | 11/1969 | Christian et al. | 164/147.1 X |
| 4,254,817 | 3/1981 | Kidowaki et al. | 164/514 |
| 4,581,745 | 4/1986 | Mathews et al. | 164/514 X |

FOREIGN PATENT DOCUMENTS

| | | | |
|---|---|---|---|
| 957412 | 11/1974 | Canada | 164/514 |

*Primary Examiner*—Nicholas P. Godici
*Assistant Examiner*—J. Reed Batten, Jr.
*Attorney, Agent, or Firm*—Koda and Androlia

[57] ABSTRACT

Metal material is melted by moving the magnetic flux of electromagnets virtually perpendicular to an arc column to apply Lorentz force to the arc column and the metal material so that the arc column can move over the metal material surface. The movement direction and speed of the arc column are determined by detecting the arc voltage of the arc column. Feed back control is performed by comparing the obtained detection data with preset data so that optimum control is performed, and the molten metal is poured into a casting mold.

6 Claims, 8 Drawing Sheets

6
21
2
6
4
(a)
3

(b)
21
2
6
6
F
B
4

ARC MELTING AND CASTING METHOD AND APPARATUS THEREOF

BACKGROUND OF THE INVENTION

1. Field of the Invention

The present invention relates to a novel method of arc melting and casting highly active (highly reactive with oxygen) metals, such as titanium, titanium alloy, niobium, tantalum, nickel, chrome and cobalt, and a novel apparatus thereof.

2. Prior Art

As well known, various metals are molten and cast using arc. With this conventional well-known melting and casting method, a metal material on a crucible in an airtight chamber is molten by an arc column generated from an arc generation electrode disposed in the airtight chamber and is poured into a casting mold disposed to receive the molten metal from the crucible.

With this method, however, the metal material begins to melt at the arc generation point and the molten area is gradually widened by heat conduction. Since melting proceeds in this way, the arc column is locally concentrated at the arc start point. This phenomenon is noticeable especially when the heat conductivity of the material (such as cobalt, nickel, chrome and titanium) is low. As a result, the material is locally overheated and casting defects such as rough casting surface and cavities are apt to generate. When an alloy (for example Ti-6Al-4V) including a metal which is easily lost due to evaporation (for example aluminum) is cast, the metal evaporates due to overheat and the composition of the alloy may change.

In addition, scraps or casting materials having irregualr shapes cannot be directly used since the arc column is fixed at one point. These materials must be molded into a regular shape (for example a cylindrical block) using a molding crucible before they are molten and cast. This requries extra electric power, processes and a molding crucible. Furthermore, since the contact area between the molten metal and the crucible is wide, the heat loss of the molten metal to the crucible is great and cannot be reduced by providing heat insulation grooves in the crucible. As a result, great electric power is consumed.

Moreover, in the case of a casting method wherein molten metal is poured through a hole in the bottom of the crucible into a casting mold closely contacting the crucible, the molten metal does not drop promptly but drops intermittently. This is apt to cause casting defects such as misrun and cold shuts. These are the problems pertinent to the conventional method.

SUMMARY OF THE INVENTION

It is therefore an object of the present invention to provide a novel melting and casting method (first invention) and an apparatus thereof (second invention) to solve all the above-mentioned problems. More particularly, an arm column is moved over a metal material by Lorentz force generated by changing magnetic field applied to the arc comlumn to ensure uniform melting and to directly melt and cast materials of irregular shapes so that less electric power is consumed and castings of higher quality can be obtained at all times.

The object of the present invention will become apparent from the following description of the accompanying drawings.

DETAILED DESCRIPTION OF THE INVENTION

Figure 1:
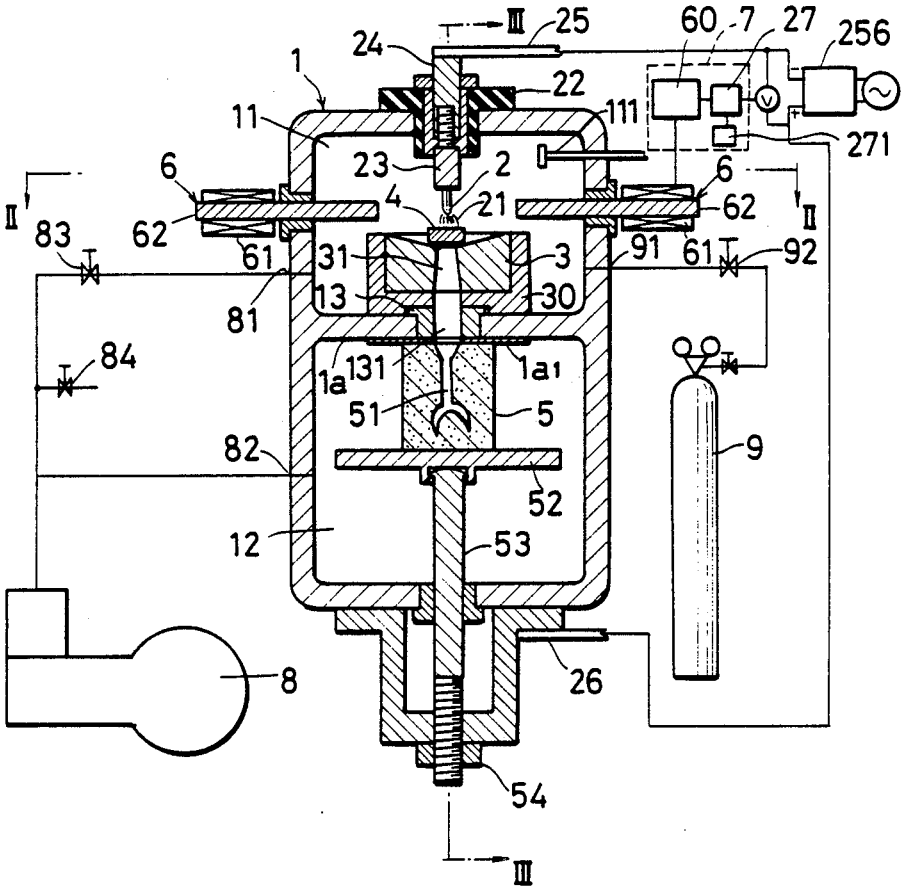
FIG. 1 is a schematic vertical sectional view illustrating a melting and casting apparatus embodying the present invention.

The first invention relates to an arc melting and casting method in which a metal material on a crucible in an airtight chamber is molten by an arc column generated from an arc generation electrode disposed in said airtight chamber and the molten metal of said metal material is poured into a casting mold disposed to receive said molten metal from said crucible, said method being characterized in that said method comprises melting said metal material by moving the magnetic flux of electromagnets virtually perpendicular to said arc column to apply Lorentz force to said arc column and said metal material so that said arc column can move over said metal material surface, finding out the movement direction and speed of said arc column by detecting the arc voltage of said arc column, performing feed back control by comparing the obtained detection data with the preset data so that optimum control is performed, and pouring said molten metal into said casting mold.

The second invention relates to an arc melting and casting apparatus comprising an airtight chamber 1, an arc generation electrode 2 electrically insulated and installed in the airtight chamber 1, a metal material 4 facing the arc generation electrode 2 and disposed on a crucible 3 having the same electric potential as that of the airtight chamber 1, a casting mold 5 disposed to receive molten metal from the crucible 3, electromagnets 6 disposed virtually perpendicular to the axis of the arc generation electrode 2, an excitation power supply 60 which supplies changing excitation current to the excitation coils 61 of the electromagnets 6, and a control circuit 7 which detects the arc voltage of the arc generation electrode 2 and properly controls the excitation current. The apparatus is characterized in that the magnetic flux of the electromagnets 6 is moved by the changing excitation current and Lorentz force is applied to the arc column 21 generated from the arc generation electrode 2 and the metal material 4 so that the arc column 21 is moved over the surface of the metal material 4 to uniformly melt the metal material 4.

Figure 4:
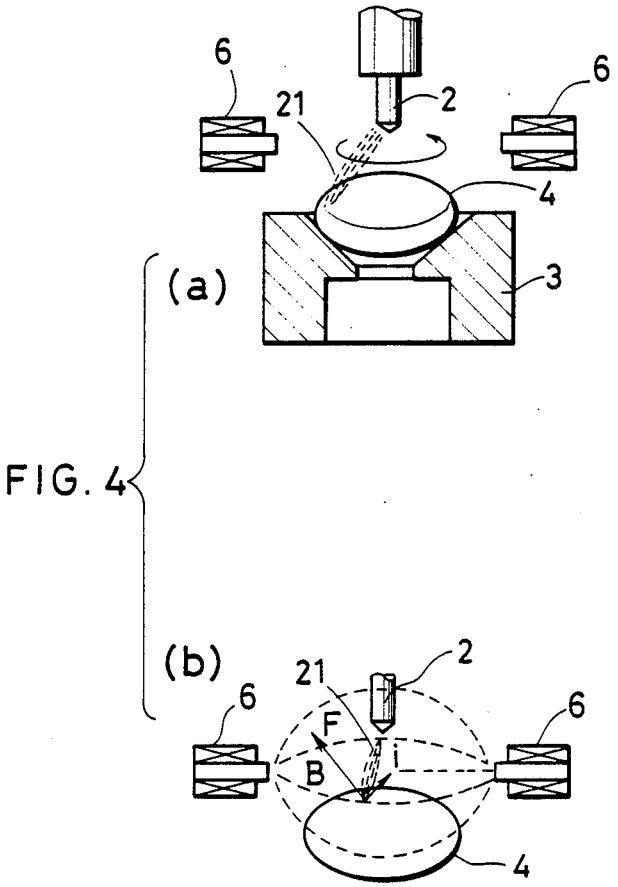
FIGS. 4(*a*) and 4(*b*) are schematic perspective views illustrating a moving arc column and its effect.

With the method of the first invention, Lorentz froce is generated by the arc current and the magnetic field change due to the electromagnet's moving magnetic flux applied to the arc column when the metal material on the crucible is molten by the arc column generated from the arc generation electrode. As a result, the arc column is moved over the metal material by the effect of the Lorentz force and the metal material is uniformly molten. This melting condition is described below referring to FIGS. 4(*a*) and 4(*b*). When magnetic field B is generated by the electromagnets 6 disposed virtually perpendicular to the arc column 21 as shown in FIG. 4(*b*), the arc column 21 having current vector i in magnetic filed B is deflected by Lorentz force F which is proportional to B×i as shown in FIG. 4(*b*). When the excitation current suppled to the excitation coils 61 of the electromagnets 6 changes, magnetic field B also changes. The deflection direction of the arc column 21 also changes as magnetic field B changes.

Accordingly, it is possible to rotate the arc column 21 around the axis of the arc generation electrode 2. as shown in FIG. 4(*a*) by changing magnetic field B. Since the arc column 21 moves over the metal material 4, the metal is uniformly molten and local melting is avoided. The movement condition or speed of the arc column 21 for uniform melting of the metal material 4 depends on the property and shape of the metal material 4 and is determined properly by disposing the proper number of the electromagnets 6 at the proper positions or by feeding back the arc voltage to control the excitation current using the control circuit 7.

Figure 6:
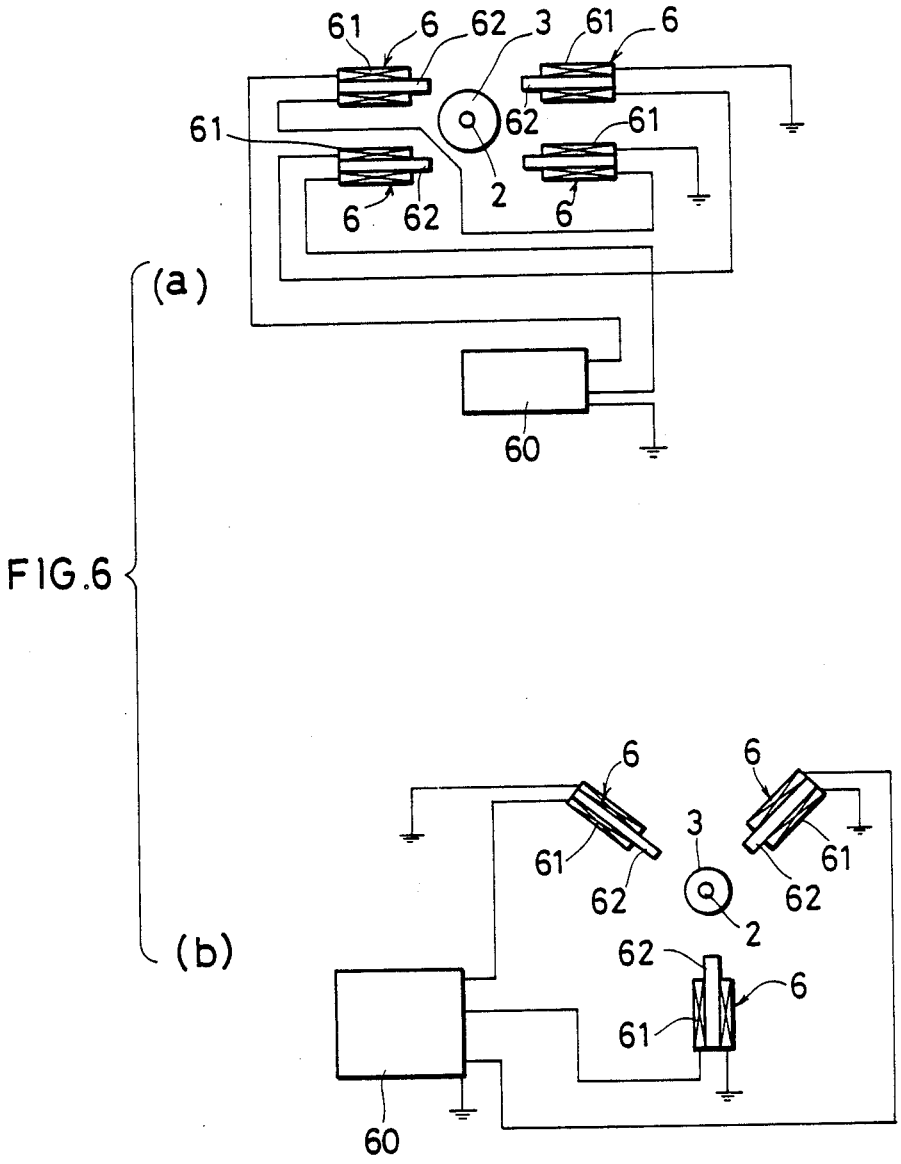
FIGS. 6(*a*) and 6(*b*) illustrate the layout of electromagnets.

The proper number of the electromagnets 6 and their layout positions are variable in many ways as shown in FIGS. 6(*a*) and 6(*b*). By properly disposing the proper number of electromagnets 6, the arc column 2 can be repeatedly rotated or moved zigzag or differently.

Figure 5:
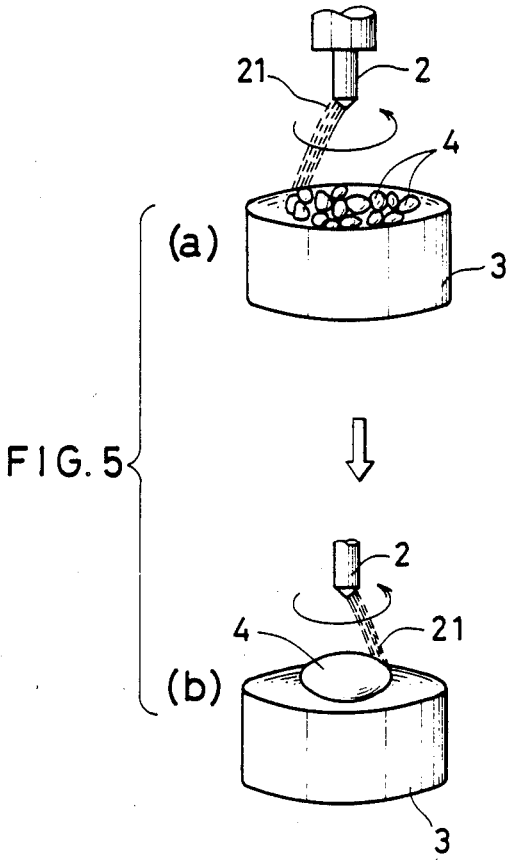
FIGS. 5(*a*) and 5(*b*) are schematic perspective views illustrating the condition of the metal molten by the arc column.

The metal material 4 on the crucible 3 is thus uniformly molten and the castings obtained by pouring the molten metal into the casting mold 5 are free from defects such as rough surface and cavities even when a metal having low heat conductivity, such as titanium, nickel or cobalt is used. Even when an alloy is used, no element of the alloy is evaporated since the alloy is not locally overheated. The composition of the alloy thus remains unchanged. Furthermore, since the arc column 21 always moves over the crucible 3, even when numerous small scraps of irregular shapes are provided as the metal material 4 as shown in FIG. 5(*a*), the scraps are molten by arc radiation and adjacent scraps merge and condense into a lump of molten metal due to surface tension as shown in FIG. 5(*b*). The lump is then used for casting in the same way as described above.

Therefore, unlike the conventional method, a troublesome process of molding such a metal material of irregular shapes into a regualr shape using a molding crucible is not necessary.

Futhermore, Lorenz force F is also applied to the metal material 4 on the crucible 3 due to magnetic field B and the metal material 4 is swung right and left while it is being molten and condenses into a lump due to surface tension. When the molten metal is dropped and cast through the hole in the crucible into the casting mold 5 disposed just under the crucible 3, the molten metal drops promptly instead of intermittently. Therefore, casting defects such as misrun and cold chuts cannot be caused.

Moreover, due to magnetic field B applied to the metal material 4, Lorentz force F is generated upward to float the metal material 4. Therefore, by properly adjusting the excitation current to the electromagnets 6 and the arc voltage using the control circuit 7, the molten metal can be slightly floated while contacting the crucible 3. As a result, the contact area of the molten metal to the crucible 3 is reduced, thus less heat scatters from the crucible 3. This greatly increases heat efficiency and decreases electric power consumption.

(EMBODIMENTS)

The embodiments of the present invention are described below.

(EMBODIMENT 1)

Figure 2:
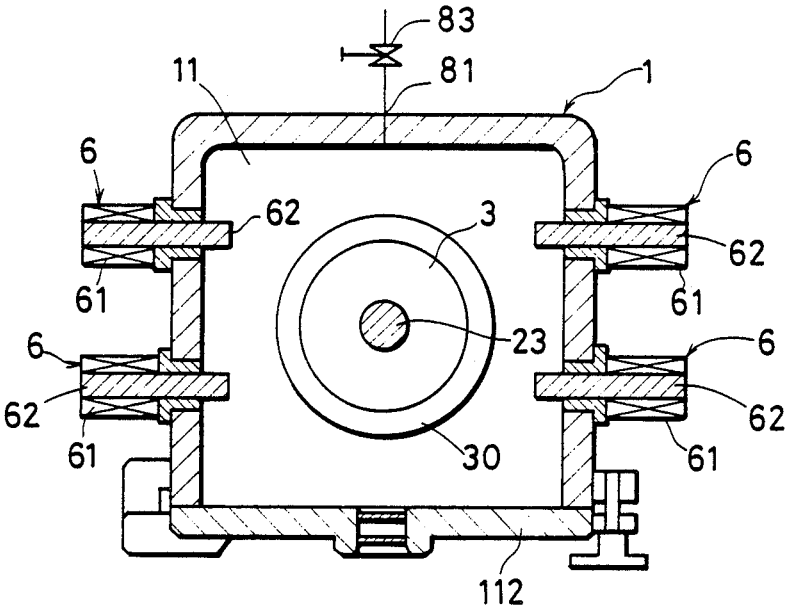
FIG. 2 is a transverse sectional view taken on line II—II of FIG. 1.
Figure 3:
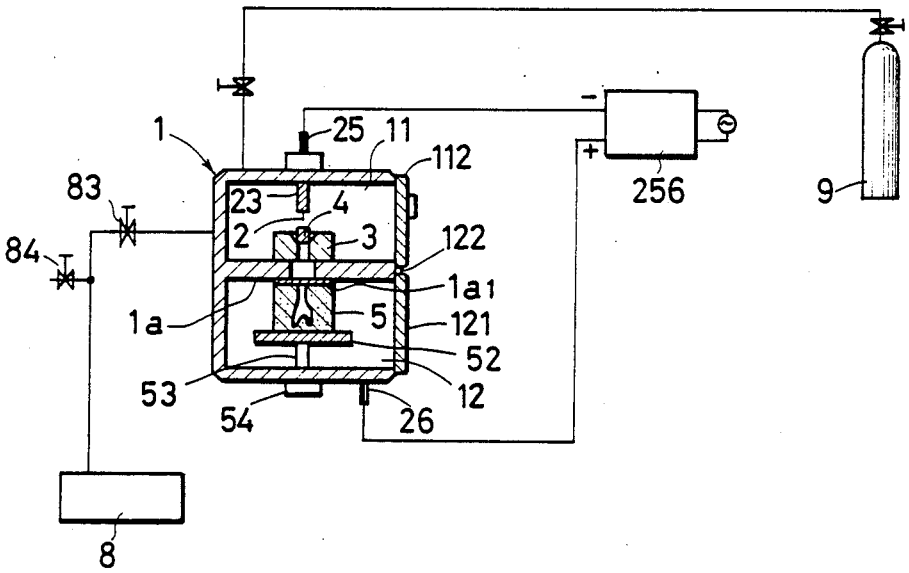
FIG. 3 is a vertical sectional view taken on line III—III of FIG. 1.

Referring to FIGS. 1, 2 and 3, the airtight chamber 1 is divided into an upper chamber and a lower chamber: a melting chamber 11 and a casting chamber 12. These chambers are partitioned by a partition wall 1*a* and a bushing 13 having a through hole 131 is installed at the center of the partition wall 1*a*. A crucible base 30 is placed on the bushing 13 and a crucible 3 having a hole 31 at its bottom is installed in the crucible base 30. This hole 31 in the crucible 3 passes the through hole 131 of the bushing 13 to communicate with the runner 51 of a casting mold 5 closely installed on the lower surface of the partition wall 1*a* via a packing $1a_1$. At the top plate of the melting chamber 11, an arc generation electrode 2 is vertically held by electrode holders 23 and 24 via an airtight insulation bushing 22 and is electrically connected to an electrode lead 25 outside the melting chamber 11. Just under the arc generation electrode 2, the crucible 3 is disposed and a proper clearance is provided between the end of the electrode and a metal material 4 supplied in the crucible 3 so that an arc column 21 can be generated. On the side walls of the melting chamber 11, four electromagnetic cores 62 are horizontally installed. An excitation coil 61 is disposed around the base end of each electromagnetic core 62 to form an electromagnet 6. The excitation coils 61 are electrically connected to an excitation power supply 60. The electromagnets 6 are laid out virtually perpendicular to the arc generation electrode 2. As the magnetic field of the electromagnets changes, the arc column 21 moves over the metal material 4. The layout and the number of the electromagnets 6 are not limited to the illustrated example, but can be changed in many ways provided that the arc generation electrode 2 functions as described above. For example, the electromagnets 6 can be installed around the arc generation electrode 2 or outside the airtight chamber 1 or in the middle of the side wall of the airtight chamber 1.

In the casting chamber 12, the casting mold 5 is closedly installed on the lower surface of the partition wall 1*a* via the packing $1a_1$ as described above. The casting mold 5 is placed on a casting mold base 52 and the casting mold base 52 is supported by a casting mold support rod 53. The casting mold supporting rod 53 is vertically movable by a casting mold elevation mechanism 54. By operating this elevation mechanism 54, the casting mold 5 can be disposed at the above-mentioned position.

An electrode lead 26 is wired to the lower surface of the airtight chamber 1, and electrically connected to the metal material 4 via the airtight chamber 1, the bushing 13, the crucible base 30 and the crucible 3 since these are made of metals. Therefore, all these members including the metal material 4 function as a receiving electrode which receives the arc generated from the arc generation electrode 2. A receiving electrode lead 26 is connected to the positive terminal of an arc generation DC power supply 256 and the arc generation electrode lead 25 is connected to the negative terminal of the power supply. The arc voltage between the electrode leads 25 and 26 is detected and the detected voltage is compared by a comparator 27 and fed back to the excitation power supply 60 so that the excitation current can be adjusted and maintained to optimize the movement speed of the arc column and the floating condition of the molten metal. The control circuit 7 comprises the comparator 27, the excitation power supply 60 and a voltage setter 271.

Exhaust ports 81 and 82 are respectively disposed in the melting chamber 11 and the casting chamber 12 and are connected to an exhaust means (vacuum pump) 8. An inlet port 91 is disposed in the melting chamber 11 and connected to an inert gas supply means (argon gas cylinder) 9. When a highly active (highly reactive with oxygen and nitrogen) metal such as titanium and titanium alloy is cast, if a slight amount of oxygn, nitrogen or moisture is present in the atmosphere, oxygen or nitrogen dissolves into the metal during melting and the metal is adversely affected significantly, becoming hard and brittle. (When the content of oxygen in titanium exceeds several hundred ppm for example, the titanium becomes abruptly harder according to measurement data.)

Therefore, the airtight chamber 1 must be free from oxygen and nitrogen. For this purpose, before the metal material 4 is placed on the crucible 3 and the metal is molten, the vacuum pump 8 is activated to exhaust air from the exhaust ports 81 and 82 and to form a high vacuum condition in both chambers 11 and 12. If the conductance of the exhaust system is increased and air leakage is prevented to increase exhaust efficiency by making the pipe between the vacuum pump 8 and the exhaust port 81 and the pipe between the vacuum pump 8 and the exhaust port 82 as short and large as possible and by disposing O-rings (not shown) at the joint sections of the exhaust ports 81 and 82, a vacuum of 0.01 torr is obtained and the airtight chamber 1 is almost free from oxygen and nitrogen. In this condition, the oxidation and nitriding of the metal material are almost prevented. However, if the degree of vacuum is as high as this value, arc generation is not stable and the arc generation electrode 2 is apt to wear out easily. To solve this problem, a melting chamber airtight valve 83 disposed in the pipe between the vacuum pump 8 and the exhaust port 81 is closed and an inert gas supply valve 92 is opened to supply inert gas from the inert gas cylinder 9 to the melting chamber 11 while air is exhausted from the casting chamber 12. The pressure in the melting chamber 11 is detected by a pressure sensor 111 disposed in the chamber and controlled to a proper value (for example 500 torr or more) suited for arc heating.

In this condition, voltage is applied between the arc generation electrode 2 and the receiving electrode. The arc voltage is detected and compared by the comparator 27 and is fed back to the excitaion power supply 60 so that the magnetic field of the electromagnets is changed to properly activate the arc column 21 over the metal material 4. In this way, uniform melting is obtained as mentioned above. Since there is a pressure difference between the melting chamber 11 and the casting chamber 12, when the metal material 4 reaches a molten condition, the molten metal promptly drops to the casting mold 5 through the hole 31 of the crucible 3 and the runner 51 due to the molten metal pressing force generated by the pressure difference and the swinging motion by the above-mentioned Lorentz force. As a result, extremely quick and smooth casting is ensured. After casting, arc discharge is stopped. After the predetermined time, the melting chamber airtight valve 83 is opened to exhaust air from the melting chamber 11 again. The vacuum pump 8 is then stopped and a leak valve 84 is opened to return the pressrues in the melting chamber 11 and the casting chamber 12 to the atmospheric pressure. In this way, the inert gas used for pressurizing the melting chamber 11 is exhausted once and then the pressure in the chamber is returned to the atmosphric pressure. Therefore, an airtight door 112 of the melting chamber 11 and an airtight door 121 of the casting chamber 12 can be opened smoothly when they are opened, ensuring safety. In addition, the airtight doors 112 and 121 (FIGS. 2 and 3) do not form a solid door but are connected by a joint 122 having elasticity as shown in FIG. 3. Therefore, even when the melting chamber 11 is under pressure and the casting chamber 12 is under vacuum, the doors 112 and 121 can ideally seal the melting chamber 11 and the casting chamber 12 without distortion.

(EMBODIMENT 2)

Figure 7:
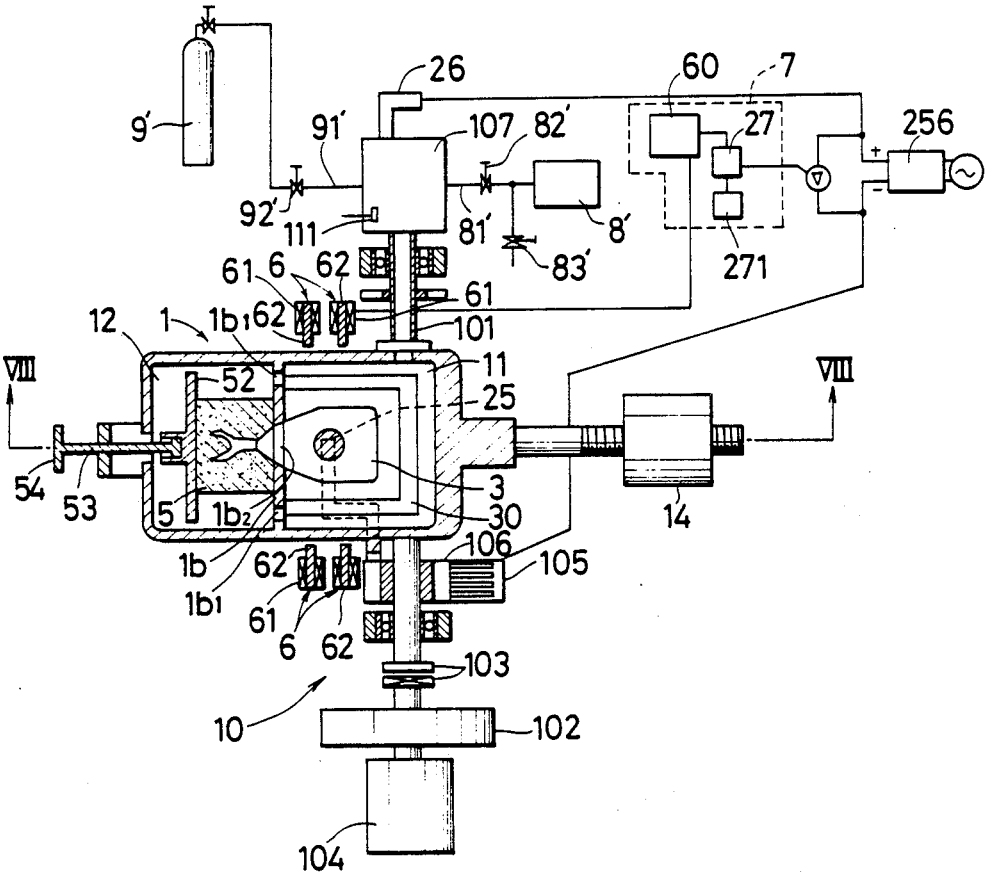
FIG. 7 is a schematic transverse sectional view illustrating another melting and casting apparatus embodying the present invention.
Figure 8:
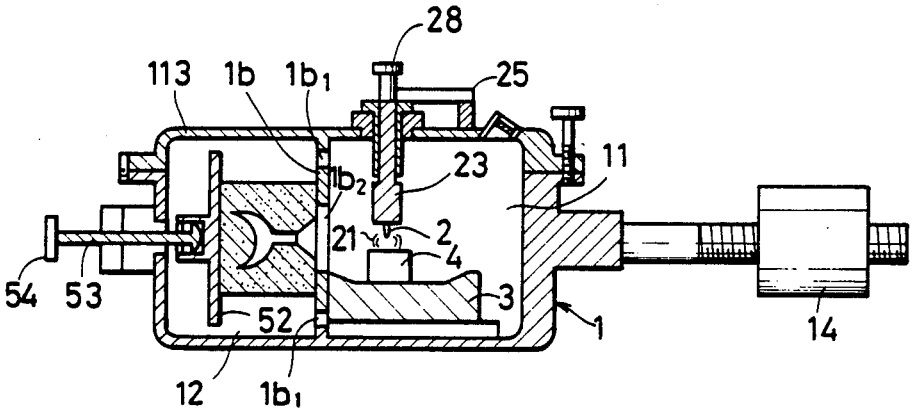
FIG. 8 is a vertical sectional view taken on line VIII—VIII of FIG. 7.

FIGS. 7 and 8 show a centrifugal casting apparatus wherein an airtight chamber 1 is rotatable by a rotation drive means 10. The airtight chamber 1 is supported by a vertical drive shaft 101. The drive shaft 101 is connected to a motor 104 via a flywheel 102 and an electromagnet clutch 103 so that the drive shaft 101 can be rotated together with the airtight chamber 1. The airtight chamber 1 is divided into a melting chamber 11 and a casting chamber 12 by a partition wall **1*b*. The two chambers 11 and 12 are connected to each other through a pressure conductance port $1b_1$ and also disposed side by side in the horizontal direction from the axis of the drive shaft 101. The casting chamber 12 is disposed on the outside of the melting chamber 11 so that a metal material 4 molten on a crucible 3 in the melting chamber 11 is forcibly poured into a casting mold 5 in the casting chamber 12 by the centrifugal force generated by rotation of the airtight chamber 1. A balance weight 14 is used to balance with the airtight chamber 1 and is horizontally disposed in the direction opposite to the airtight chamber 1 from the drive shaft 101. The position of the balance weight 14 is adjustable. The entire top plate of the airtight chamber 1 forms a door 113 (FIG. 8). An arc generation electrode 2 is installed on the door 113 and is vertically adjustable using an electrode height adjustment handwheel 28. An electrode lead 25 is electrically connected to the handwheel 28. Since the arc generation electrode 2 is rotated together with the airtight chamber 1 in the case of this embodiment, the arc voltage to the electrode 2 is supplied through an arc generation electrode comprising a fixed brush 105 connected to the negative terminal of an arc generation DC power supply 256, a slip ring 106 rotatably contacting the brush 105 and fixed on one side of the drive shaft 101, the electrode lead 25 electrically connected to the slip ring 106 and a receiving electrode lead 26 connected to the positive terminal of the arc generation DC power supply 256 and the airtight chamber 1 via a mechanical seal 107 described below. Electromagnets 6 are installed outside the airtight chamber 1** and fixed virtually perpendicular to the arc generation electrode 2. The magnetic field of the electromagnets 6 is applied to an arc column 21 through the wall of the airtight chamber 1. The excitation power supply 60 for the electromagnets 6 is combined with a comparator 27 and a voltage setter 271 to form a control circuit 7 to optimize the movement speed of the arc column 21 and the molten metal floating condition.

The other side of the drive shaft 101 (opposite to the side where the slip ring 106 is fixed) is hollow. The open end of the hollow shaft is airtightly and rotatably enclosed by the box-shaped mechanical seal 107. An exhaust pipe 81' connected to a vacuum pump 8' and an inert gas supply pipe 91' connected to an inert gas (for example argon) cylinder 9' are further connectd to the mechanical seal 107. These pipes pass to the airtight chamber 1 through the mechanical seal 107 and the hollow section of the drive shaft 101.

In the melting chamber, the crucible 3 is installed under the arc generation electrode 2 and the metal material 4 is placed on the crucible 3. In the casting chamber 12, the casting mold 5 closely contacts the partition wall **1*b* so that the molten metal can be poured from the crucible 3 to the casting mold 5 through the port $1b_2$ in the partition wall 1*b* by a centrifugal force. The casting mold 5 closely contacts the partition wall 1*b* using the casting mold base 52, the casting base support rod 53 and the elevation mechanisem which are used in the first emodiment, although these are positioned horizontally in the case of the second embodiment. The melting and casting procedure of the second embodiment is described below. First drive the vacuum pump 8' to exhaust air from the melting chamber 11 and the casting chamber 12 through the mechanical seal 107 and the hollow section of the drive shaft 101. When the degree of vacuum detected by a pressure sensor 111 in the mechanical seal 107 reaches 0.01 torr, close the exhaust valve 82' in the exhaust pipe 81' and open a valve 92' in the middle of the inert gas supply pipe 91' to supply inert gas from the inert gas cylinder 9' to the melting chamber 11 and the casting chamber 12 to set the degree of vacuum in these chambers at 500 torr for example. Next activate the arc generation DC power supply and apply voltage to the arc generation electrode 2 to generate the arc column 21. At the same time or after the predetermined time, activate the excitation power supply 60 to suply changing current to the excitation coils 61. At this time, the arc voltage is detected and compared by the comparator 27, and then fed back to the excitation power supply 60 to maintain the exciting current at the proper value. By visual observation or other detection means, check that the metal material 4 has been sufficiently molten, activate the electromagnetic clutch 103 to connect the airtight chamber 1 to the motor 104, which has been already driven, and to rotate the entire airtight chamber 1. Immediately after starting the rotation, stop arc generation. As the airtight chamber 1 is rotated, the molten metal on the crucible 3 is efficiently poured into the casting mold 5 by a centrifugal force. After pouring the molten metal, release the electromagnetic clutch 103 and apply the brake to stop rotating the airtight chamber 1. Open the exhaust valve 82' and a leak valve 83' to set the pressure inside the airtight chamber 1** at the atmospheric pressure.

In this embodiment, Lorentz force generated by the changing magnetic field and arc current is also applied to the arc column 21. Like the embodiment 1 described above, the arc column 21 moves over the metal material 4 to uniformly melt the metal material 4 and to obtain high-quality castings. By Lorentz force, the molten metal is floated while it is in contact with the crucible 3, increasing heat efficiency.

The parts commonly used for embodiment 1 are represented by like numerals in the above description and are not detailed here.

(EMBODIMENT 3)

Figure 9:
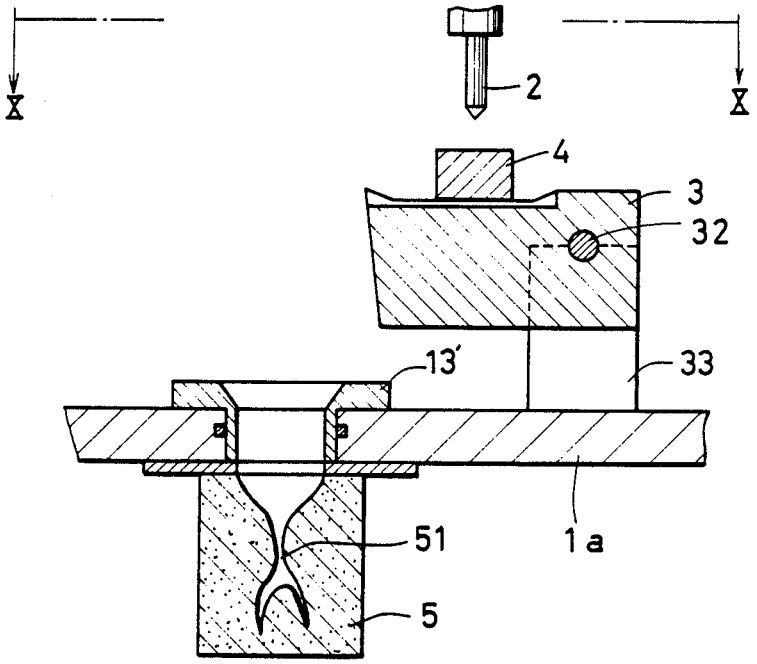
FIG. 9 is a schematic view illustrating the third casting apparatus.
Figure 10:
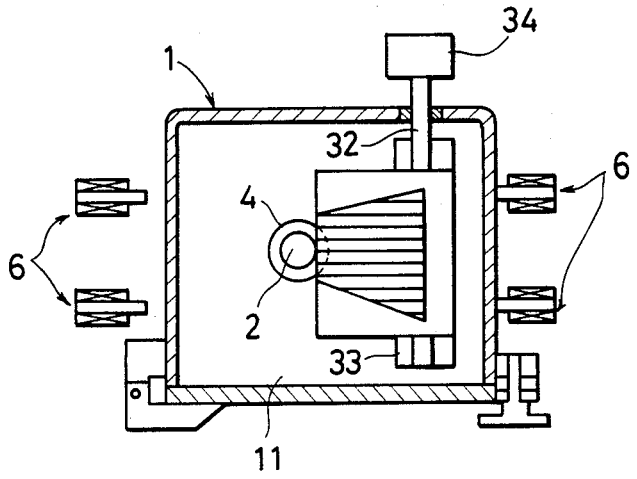
FIG. 10 is a transverse sectional view taken on line X—X of FIG. 9.

The third casting embodiment is shown in FIGS. 9 and 10. Like embodiment 1, the airtight chamber 1 is divided into the upper and lower chambers: a melting chamber 11 and a casting chamber 12. In the melting chamber 11, a crucible 3 is supported by a shaft 32 and a shaft support base 33 so that the crucible can be inclined back and forth. In the casting chamber 12, a casting mold 5 closely contacts a partition wall **1*a*. On the casting mold 5, a funnel-shaped bushing 13' is disposed and borders on the melting chamber 11. The operation procedure of this embodiment is described below. By visual observation or other detection means, check that the metal material 4 on the crucible 3 has been sufficiently molten, and operate an actuator 34 extended outside the airtight chamber 1 to incline the crucible 3 and to pour the molten metal into the casting mold 5**. This embodiment is preferable just as embodiments 1 and 2.

(EMBODIMENT 4)

Figure 11:
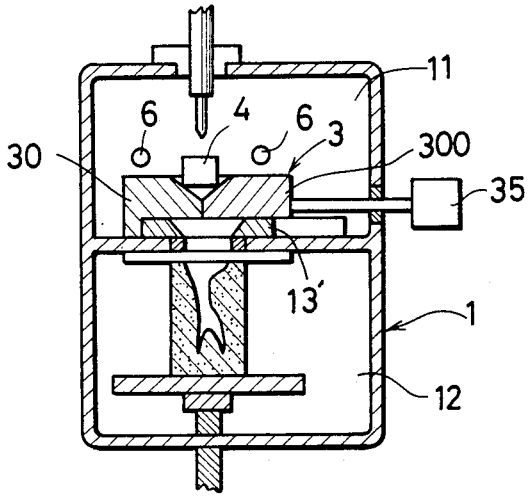
FIG. 11 is a vertical sectional view of the fourth casting apparatus.

A modification example of the casting apparatus is shown in FIG. 11. The crucible 3 of this example is divided into a left piece 30 and a right piece 300. The left piece 30 is fixed on the partition wall **1*a* and the right piece 300 can be slided right and left by an actuator 35. By operating the actuator 35 to move the right piece 300 backwards after a metal material 4 is molten, the molten metal is poured from the clearance between the two pieces into a casting mold 5 through a funnel-shaped bushing 13'**. This embodiment is also preferable.

The present invention is not limited to the above embodiments but can be modified variously within its spirit and scope a set out in the accompanying claims.

When the metal material on the crucible is molten by the arc column generated from the arc generation electrode using the arc melting and casting method (first invention) and the apparatus thereof (second invention), the moving magnetic flux of the electromagnets apply to the arc column and by the change of the magnetic field due to the moving magnetic flux and arc current, Lorentz force is generated in the magnetic field as described above. The arc column is thus moved over the metal material on the crucible by the Lorentz force to uniformly melt the metal material. Therefore, even when a metal, which is low in heat conductivity, such as nickel and cobalt, is used, castings obtained by pouring such a metal into a casting mold are free from casting defects such as rough surface or cavities. Even when an alloy including an evaporative metal is cast, the metal is not evaporated since the alloy is not locally overheated. The composition of the alloy remians unchanged. Since the arc column always moves over the crucible, the arc is effectively radiated to the metal material even when the metal material is compsed of numerous scraps of irregular shapes. Therefore, such scraps can be directly molten, condensed and used for casting. Accordingly, unlike the conventional method, it is not necessary to perform a troublesome process of forming scraps into a regular shape in a forming crucible. This prevents metal material from being wasted and needs less electric power consumption. Efficient casting is thus ensured. Furthermore, since the Lorentz force is also applied to the metal material on the crucible, the metal material is swung right and left by the Lorentz force. When the molten metal is poured into the casting mold closely contacting the lower surface of the crucible having a hole on the bottom, the molten metal drops promptly into the casting mold. This eliminates casting defects such as misrun and cold shuts.

Moreover, since the molten metal on the crucible can be slightly floated by the Lorentz force while contacting the crucible, the contact area of the molten metal to the crucible is reduced and less heat scatters from the crucible. This greatly decreases electric power consumption.

The apparatus of the present invention is simple in construction and can be made compact.

The method and apparatus of the present invention characterized as described above are ideally suited or a dental casting apparatus wherein precision casting is required.

Having described our invention as related to the embodiments shown in the accompanying drawings, it is our intention that the invention be not limited by any of the details of description, unless otherwise specified, but rather be constructed broadly within its spirit and scope as set out in the accompanying claims.

We claim:

1. An arc melting and casting method in which a metal material in a crucible in an airtight chamber is melted by an arc column generated from an arc generation electrode disposed in said airtight chamber and the molten metal of said metal material is poured into a casting mold disposed to receive said molten metal from said crucible, wherein said airtight chamber is divided into a melting chamber and a casting chamber, and the pressure in said melting chamber is set higher than that in said casting chamber so that said metal material melted in said melting chamber is forcibly poured into said casting mold in said casting chamber using the pressure difference, said method being characterized in that said method comprises melting said metal material by moving the magnetic flux of electromagnets substantially perpendicular to said arc column to apply Lorentz force from outside said airtight chamber to said arc column and said metal material so that said arc column can move over said metal surface, determining a direction of movement and speed of said arc column by detecting an arc voltage of said arc column, performing feed back control by comparing the detected arc voltage with a preset arc voltage so that optimum control is performed, and pouring said molten metal into said casting mold, and controlling an excitation current of said electromagnets depending on said detected arc voltage so that said metal material is slightly floated from said crucible by said Lorentz force when said material is melted.

2. An arc melting and casting method according to claim 1, further comprising applying a centrifugal force to said molten metal so that said molten metal is forcibly poured into said casting mold.

3. An arc melting and casting apparatus comprising an airtight chamber, an arc generation electrode electrically insulated and installed in said airtight chamber, a crucible having the same electric potential as that of said airtight chamber, a metal material facing said arc generation electrode and disposed in said crucible, a casting mold disposed to receive molten metal from said crucible, electromagnets disposed outside said airtight chamber and virtually perpendicular to the axis of said arc generation electrode, an excitation power supply which supplies changing excitation current to the excitation coils of said electromagnets, and a control circuit which detects the arc voltage of said arc generation electrode and properly controls said excitation current, and wherein said airtight chamber is divided into said melting chamber which includes at least said arc generation electrode and said crucible and said casting chamber which includes at least said casting mold, exhaust ports connected to a vacuum or exhaust means are disposed in said melting chamber and said casting member respectively, and an inlet port connected to an inert gas supply means is disposed in said melting chamber, whereby the magnetic flux of said electromagnets is moved by said changing excitation current to apply Lorentz force to the arc column generated from said arc generation electrode and said metal material so that said arc column is moved over the surface of said metal material to uniformly melt said metal material, and said arc voltage and said excitation current are controlled so that said metal material can be slightly floated from said crucible by said Lorentz force.

4. An arc melting and casting apparatus according to claim 3, wherein a rotation drive means is provided to rotate said airtight chamber, and said crucible and said casting mold are disposed close to each other so that the molten metal is forcibly poured from said crucible into said casting mold using the centrifugal force generated by the rotation of said airtight chamber.

5. An arc melting and casting apparatus according to claim 4 or 3, wherein said crucible is adapted to be inclined back and forth and further comprising a bushing provided on said casting mold bordering in said melting chamber, whereby soon after the metal material in said crucible has been sufficiently melted, the molten metal in said crucible is promptly poured into said casting mold via the inclination of said crucible.

6. An arc melting and casting apparatus according to claim 4 or 3, wherein said crucible is divided into two pieces in such a manner that one is fixed immovable and the other is slidable to the right and left to the former, whereby soon after the metal material in said crucible has been sufficiently melted, the molten metal in said crucible is promptly poured into said casting mold via the sliding of said crucible.

* * * * *